US005400978A

United States Patent [19]

Strohmeyer

[11] Patent Number: 5,400,978

[45] Date of Patent: Mar. 28, 1995

[54] BLADE AND STRIPPER ASSEMBLY FOR A PAPER SHREDDER

[75] Inventor: Willi Strohmeyer, Hanover, Germany

[73] Assignee: Geha-Werke GmbH, Hanover, Germany

[21] Appl. No.: 106,490

[22] Filed: Aug. 13, 1993

Related U.S. Application Data

[63] Continuation of Ser. No. 844,824, Mar. 3, 1992, abandoned.

[30] Foreign Application Priority Data

Mar. 4, 1991 [DE] Germany ..... 41 06 792.4

[51] Int. Cl.[6] ..... B02C 18/16

[52] U.S. Cl. ..... 241/166; 241/236; 241/285.1

[58] Field of Search ..... 241/236, 166, 167, 285 R; 83/114

[56] References Cited

U.S. PATENT DOCUMENTS

| | | | |
|---|---|---|---|
| 4,018,392 | 4/1977 | Wagner | 241/167 |
| 4,545,537 | 10/1985 | Kimura et al. | 241/236 |
| 5,071,080 | 12/1991 | Herbst et al. | 241/236 |

FOREIGN PATENT DOCUMENTS

| | | |
|---|---|---|
| 0010681A1 | 10/1979 | European Pat. Off. . |
| 0441182A1 | 1/1991 | European Pat. Off. . |
| 3616554A1 | 11/1987 | Germany . |
| WO91/12890 | 9/1991 | WIPO . |

*Primary Examiner*—Eugenia Jones
*Assistant Examiner*—Allan M. Schrock
*Attorney, Agent, or Firm*—Herbert Dubno; Andrew Wilford

[57] ABSTRACT

A cutter and stripper assembly of a shredder has a lower housing part injection-molded with a receptacle in which an injection-molded stripper block is received. The stripper block has fingers reaching between the blades of the blade shaft and braced by ribs injection-molded on the upper part of the housing.

11 Claims, 5 Drawing Sheets

BLADE AND STRIPPER ASSEMBLY FOR A PAPER SHREDDER

This is a continuation of application Ser. No. 07/844,824, filed on Mar. 3, 1992, now abandoned.

FIELD OF THE INVENTION

My present invention relates to a blade and stripper assembly for a paper shredder, i.e., a shredding machine capable of destroying information carriers such as printed paper, film, magnetic information carriers or the like.

BACKGROUND OF THE INVENTION

A paper shredder generally comprises a pair of blade shafts in a shredder housing, the shafts having interdigitating rotating blades into which the paper or other sheet material carrying information is fed so that the information carrier will be cut up into strips and collected in a bin, chamber or other collector with which the cutting assembly is associated. Additional cutter elements may also be provided to further subdivide the strips.

Generally between the blades of each shaft in the cutter zone stripper bars or fingers may be provided to prevent the cut-up information carriers from collecting around the blade shaft and for guiding the cut material into a collector. A collecting of the comminuted material between the blades can lead to an interruption in the operation of the shredder.

In German Open Application DE 0S 36 16 554, a stripper element in the form of a bar grate is provided in one piece and is fastened at the lateral points of the cutter assembly at which the bearings of the blade shafts are mounted. This system can be complex and expensive.

OBJECTS OF THE INVENTION

It is, therefore, the principal object of my present invention to provide an improved shredder construction whereby the disadvantages of earlier cutter and stripper assemblies are avoided.

A more specific object of the invention is to provide a blade and stripper assembly for a shredder which is of simpler construction, having fewer parts than earlier systems and which reduces the amount of work needed for assembly, mounting and adjustment of the various parts.

It is also an object of this invention to provide an improved cutter and stripper assembly for a paper shredder or the like which is of lower cost than earlier systems.

SUMMARY OF THE INVENTION

These objects and others which will become more readily apparent hereinafter are attained with a blade and stripper assembly for a paper shredder which comprises:

- a pair of blade shafts having interdigitating rotating paper-shredder blades with interstices between the blades of each shaft;
- a shredder housing receiving the blade shafts and formed with a receptacle extending along the pair of blade shafts;
- a stripper block received in the receptacle and having rows of stripper fingers received in the interstices between the blades of the respective shafts; and

- respective support ribs formed in the housing and extending along the rows, the support ribs and the fingers having mutually engaging complementary surfaces bracing the fingers against the ribs in an assembled state of the assembly.

In this system the stripper fingers or bars are provided unitarily with a stripper block which is received as a unit in a receptacle or socket formed in a part of the housing of the shredder, thereby simplifying the construction of the apparatus and reducing the cost by comparison with systems in which the stripper is formed by a number of different parts.

The provision of a stripper block with all of the stripper bars or fingers unitary therewith allows the stripper to have the requisite stability since the stripper fingers are engaged by or braced with the support ribs of the opposite housing part. The stripper fingers and the stripper ribs have complementary and mutually engaging support surfaces which in the mounted state of the blade or cutter unit bear upon one another, bracing the stripper fingers against displacement inwardly, i.e., toward the channel through which the paper is guided, and in addition, fix the stripper fingers and the entire stripper block in position.

According to a feature of the invention the receptacle for the stripper block has the configuration of a tray and the stripper block is received in the receptacle with play. This allows the stripper block to adjust to the usual fabrication tolerances of the blade shafts or the shredders automatically. In particular, the stripper block can position itself upon mounting of the blade shaft in the housing automatically with respect to the position of the blades of the shafts.

Since the bracing surfaces of the stripper fingers and the stripper ribs are angled with respect to one another a wedging action can be applied by the ribs against the fingers which tends to urge the latter towards the respective blade shafts so that in the completed assembly the parts are fixed with high stability.

According to another feature of the invention, the stripper block is an injection-molded part, preferably a plastic injection-molded part, with the stripper fingers being injection-molded as part of that block. Similarly the support ribs can be formed in one piece with one of the housing parts by injection-molding from a plastic or synthetic resin. This also serves to simplify the construction of the cutter and stripper assembly. Of course, in some cases it may be desirable or advantageous to form the support ribs by injection-molding as a support block in a socket or receptacle of the respective housing part. In this latter case an additional injection-molding die is required, but, the additional die is less expensive and simpler to fabricate than the more complex die required if the ribs are formed in one piece with, for example, one of the housing parts.

It is important to note that the formation of the stripper fingers in a block by injection-molding allows the stripper blocks to be replaced to match the blade spacing and dimensions where assembly of the stripper may use different cutter assemblies for different models.

Advantageously the socket or receptacle for the stripper block is formed in the lower part of the housing while the ribs are molded or otherwise formed on the housing upper part. The bracing surfaces of the stripper fingers of the support ribs will then lie above the cutting zone of the blade assembly in the region of the paper guide so that edges of the ribs or fingers cannot have any negative effect on the function of the stripper fingers. A blockage resulting from accumulation of comminuted paper in the cutter assembly or resulting from engagement of paper with edges of the stripper can thus be completely excluded.

When journal surfaces are formed by injection-molding in the upper part or lower part of the housing in addition to the receptacle for the stripper block and the bracing ribs, the mounting of the blade shafts themselves is further simplified. This simplification can be further augmented by forming during the injection-molding of a compartment for the drive motor or bearing or support surface for a transmission which can be interposed between the motor and the blade shafts. Because of the injection-molding of all the supporting parts in the housing, all of the key components of the outer assembly can be accurately positioned with respect to one another without the need for adjustment or careful positioning. The final assembly is facilitated by allowing the stripper blade to adjust itself in position because it is received a play in its receptacle

BRIEF DESCRIPTION OF THE DRAWING

The above and other objects, features, and advantages will become readily apparent from the following description, reference being made to the accompanying drawing in which.

SPECIFIC DESCRIPTION

Figure 1:
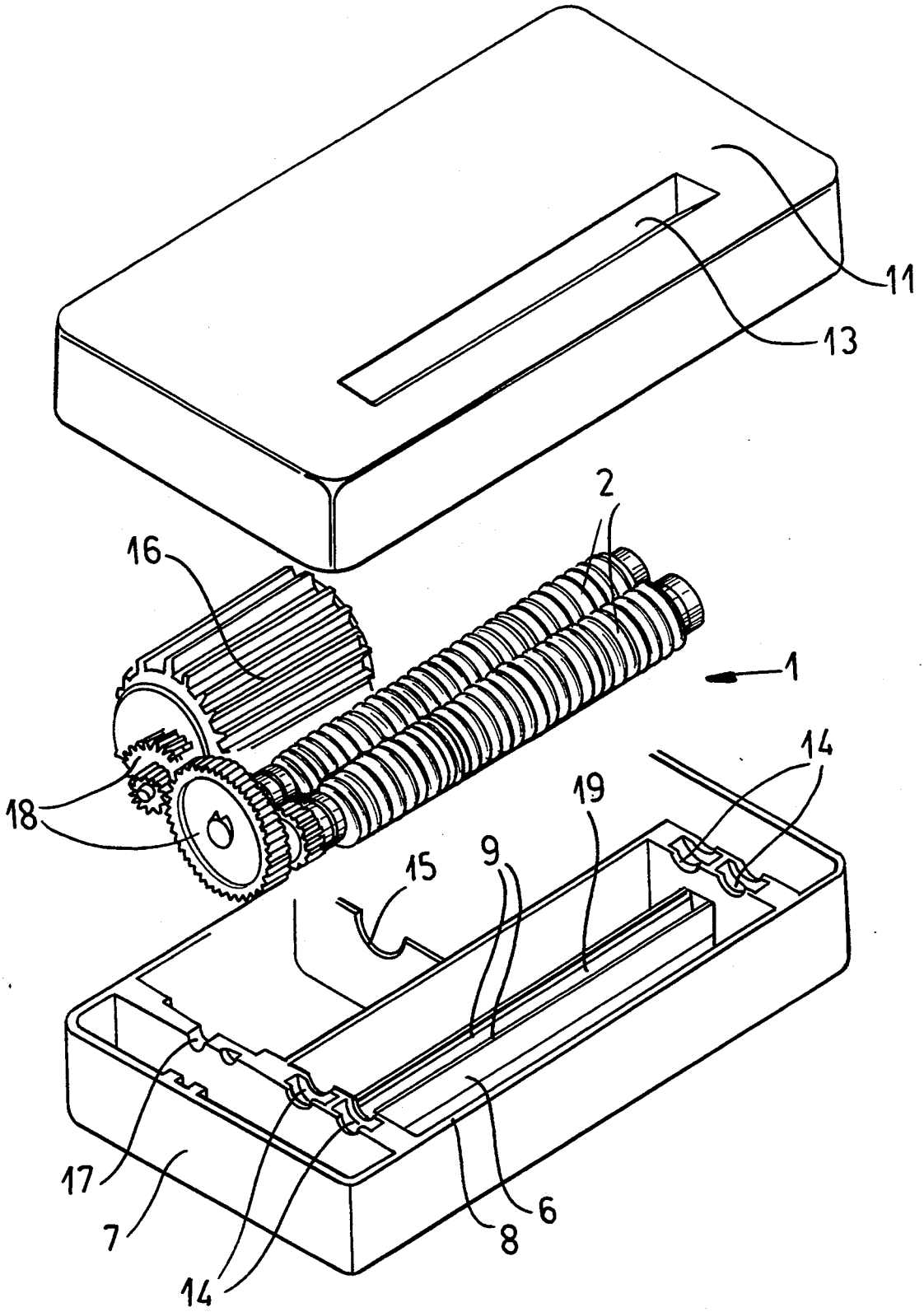
FIG. 1 is a diagrammatic partially exploded view of the cutting and stripping assembly of a paper shredder according to the invention.
Figure 2:
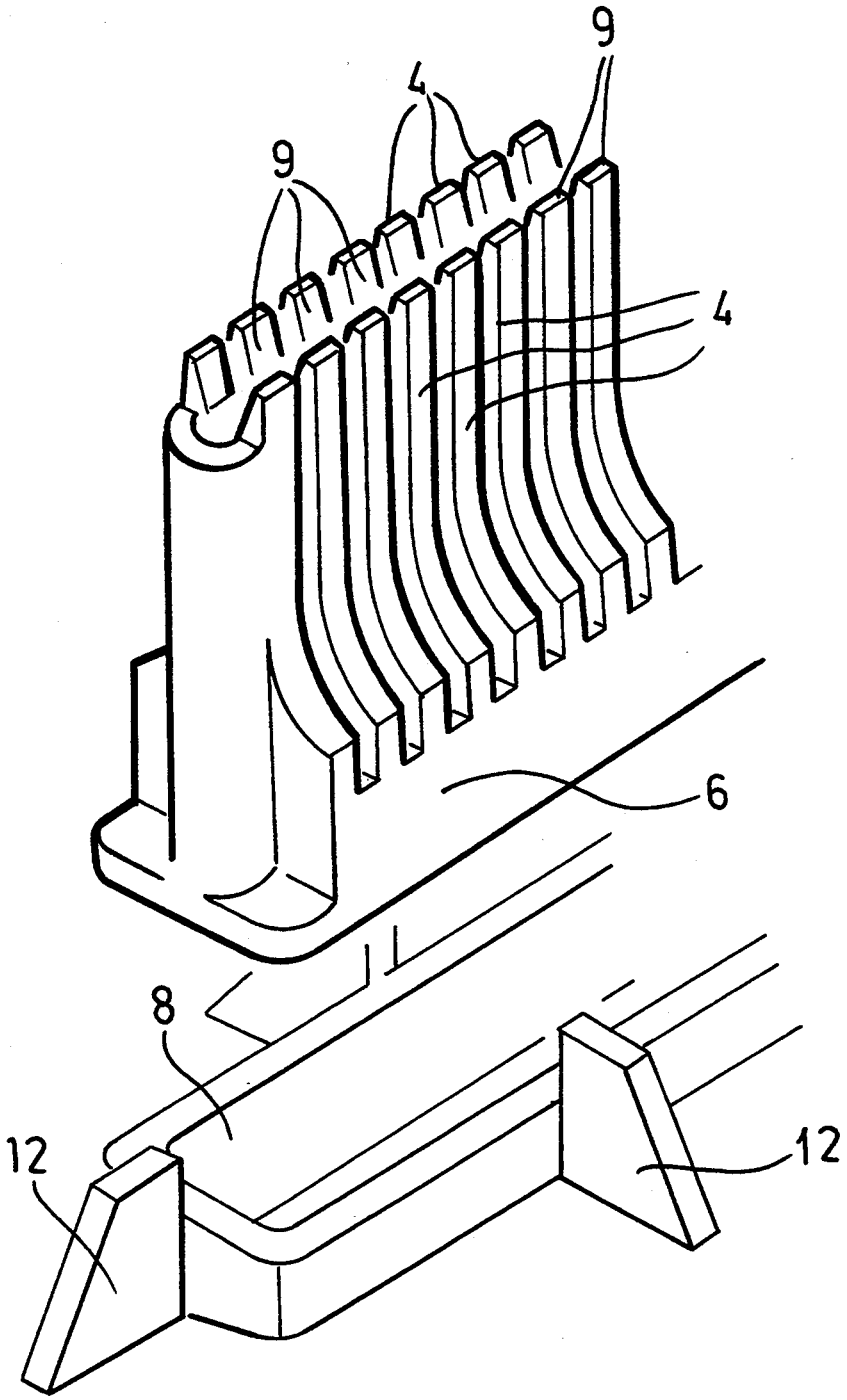
FIG. 2 is a detail exploded view showing the stripper block and its receptacle with the stripper block enlarged in scale with respect to the receptacle.

In the drawing, I have shown at 1 a cutter unit of a paper shredder whose lower portion has not been illustrated and may include a bin or collector for the paper. Alternatively, the cutter assembler may simply be placed upon a waste basket which can serve as a collector.

The cutting unit 1 comprises two blade shafts 2 which extend parallel to one another and carry interdigitating blades 3 which are circular and serve to comminute an information carrier in sheet form guided between the blade shafts as is conventional in the paper shredder art.

Figure 4:
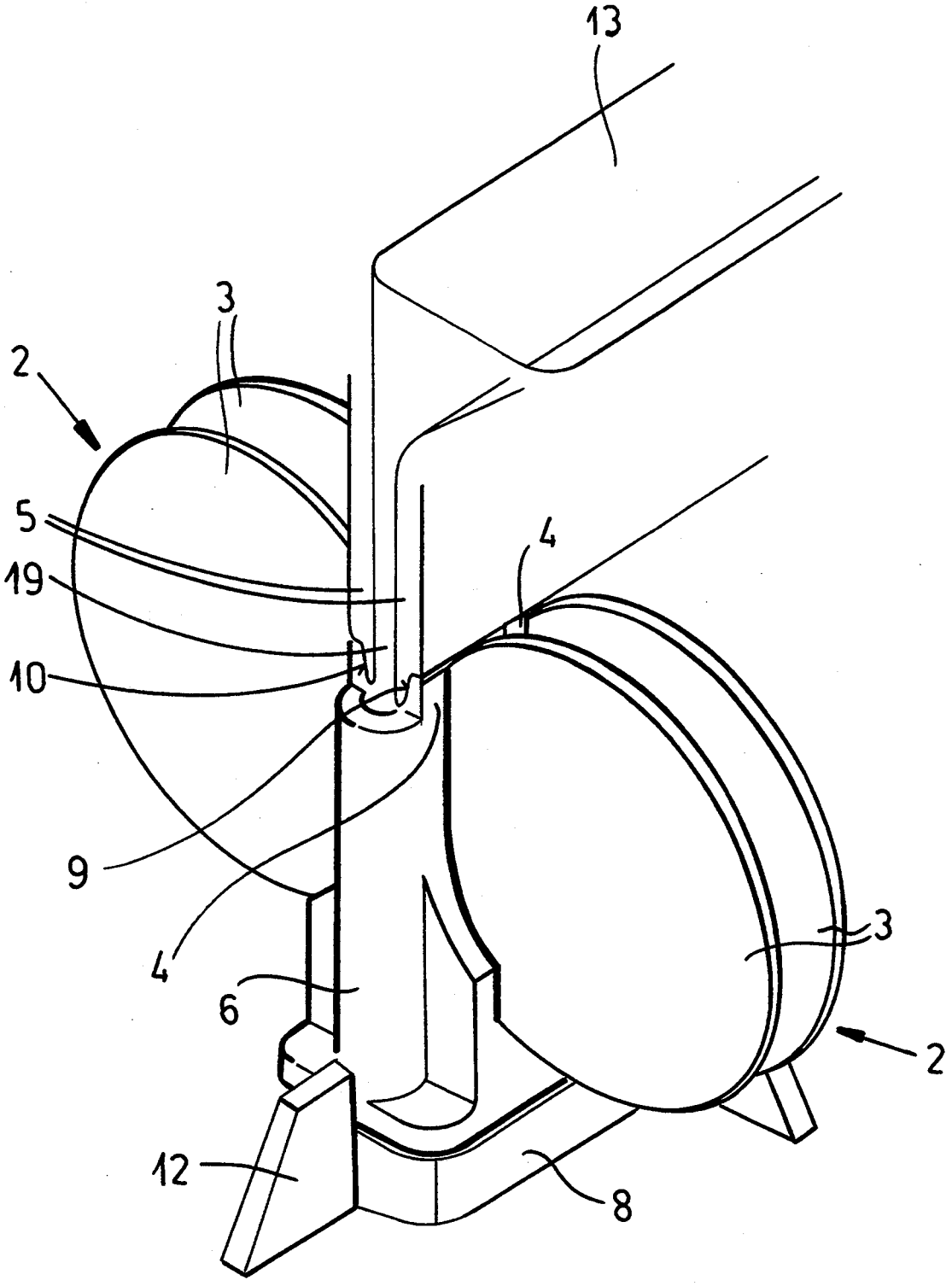
FIG. 4 is a diagrammatic perspective view to a larger scale from FIG. 1 and approximately the same scale as in FIG. 3 diagramatically illustrating a stripper assembly in its mounted position.
Figure 5:
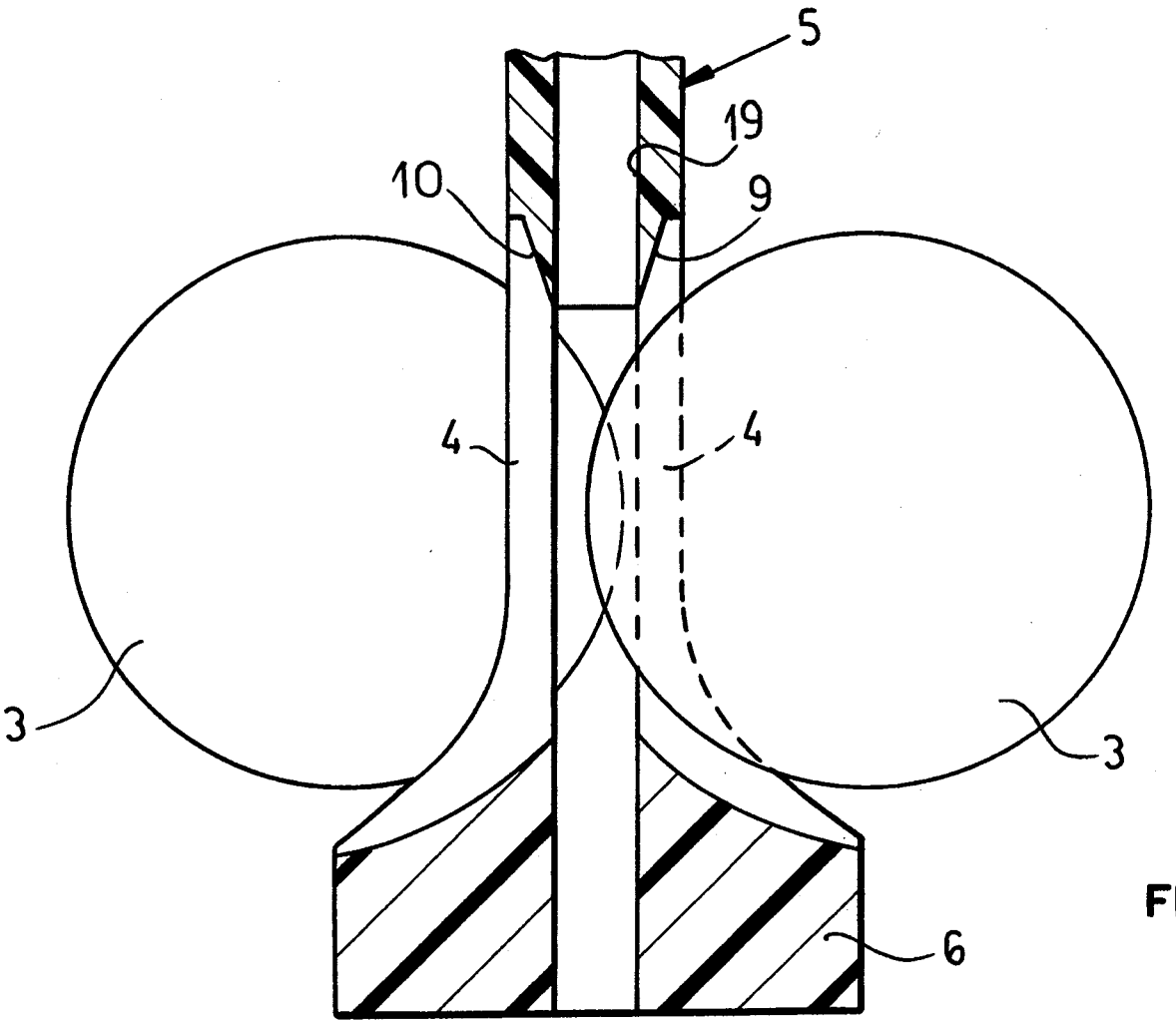
FIG. 5 is a cross-sectional view showing details of the engagement of the support ribs, the stripper fingers and the blades of the blade shaft.

The blade shafts have not been shown in FIGS. 4 and 5 and the blades 3 thereof having only been indicated as circles for convenience of illustration.

The two blade shafts 2 are provided with a stripper device comprised of two rows of strippers bars or fingers 4 which are injection-molded of a synthetic resin or plastic in one piece to form a stripper block 6. The rows of stripper fingers therefore are braced by support ribs 5.

As will become apparent from FIGS. 4 and 5 the stripper fingers 4 engage in the interstices between the blades 3 of the blade shafts 2 and can fill these interstices to prevent the accumulation of comminuted sheet material in the interstices.

Figure 3:
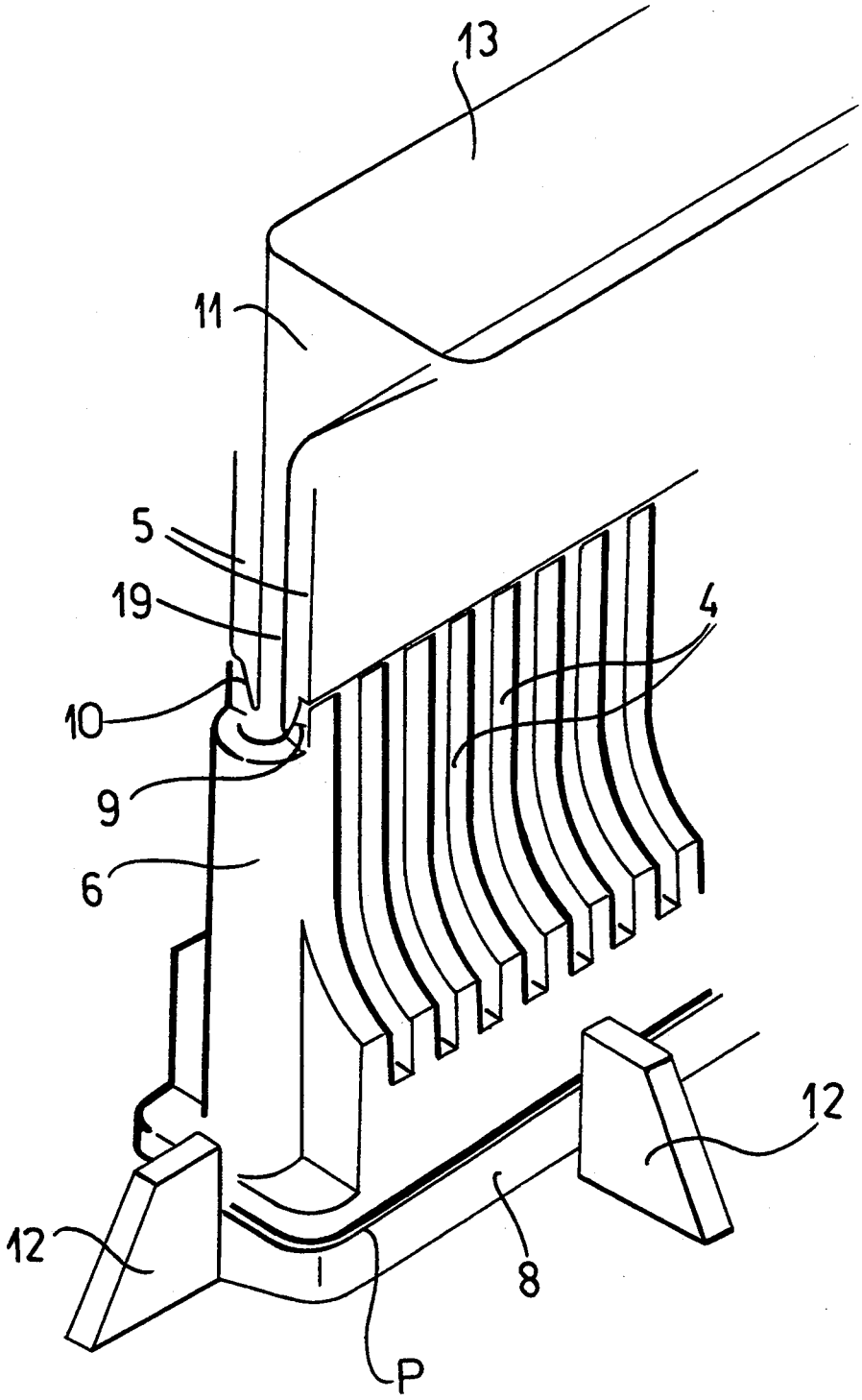
FIG. 3 is a detail view of the stripper block in its receptacle showing the stripper fingers braced by the support ribs.

The fingers 4 of each row form a comb through which respective blade 3 projects as is especially apparent from FIG. 4. The cover part of the housing of the shredder is molded unitarily with a tray-shaped receptacle 8 receiving the stripper block 6. FIG. 3 shows the stripper block 6 to be received in the housing with a play in a horizontal plane represented at P so that it can automatically adjust to the position and manufacturing tolerances of the blade of the respective blade shaft 2.

The support ribs 5 are formed at their lower ends with angled bracing surface or bevels 9 which are configured to abut the support surfaces 10 formed at the ends of the stripper fingers 4 in the mounted state of the assembly and with the blade unit 1 in place, i.e., with the upper part 11 of the housing closed on the lower part 7 thereof, the support surfaces 9 lie upon and brace the support surfaces 10.

As will be apparent from FIG. 3 the support surfaces 9 of the ribs 5 hold the support surfaces 10 of the fingers 4 so that the block 6 is braced in the vertical direction against the floor of the receptacle 3 and the fingers are braced against lateral movement or lateral shifting of the stripper fingers 4 by the paper passing through the guide channel 19 of the upper housing in the direction of paper movement perpendicular to the longitudinal axes of the blade shirt 2.

The stability of the cutting assembly 1 can be increased by reinforcing ribs 12 molded on the receptacle 8. The engagement of the fingers and the support ribs 5 also enhances the stability of the housing formed by the lower part 7 and the upper part 11 of the shredder.

From the drawing it will also be apparent that the upper part 11 of the housing is formed with a paper inlet slot 13 through which the paper to be shredded is fed. In the housing lower part 7 and in the housing upper part 11 as can be seen from FIG. 1 bearing surfaces 14 are provided on which the shafts 2 are journaled. These bearing surfaces 14 and the receptacle 8 for the stripper block 7 are injection-molded in the lower part 7 of the housing or in the upper part 11 as required. The same applies for a receptacle or compartment 15 for a drive motor 16 of the blade unit 1. In the housing upper part 11 and lower part 7, further bearing surfaces 17 can be injection-molded for a transmission 18 and the transmission 18 is interposed between the motor 16 and the blade shafts 2 of the cutter unit 1.

As is conventional the information carrier such as paper is fed through the guide slot 13 and is slitted by the blades 3 of the blade shaft 2. The overlapping blades 3 comminute the paper while the stripper fingers prevent the paper from entering the interstices between the blades. The comminuted paper passes downwardly between the two rows of fingers 4 through the paper channel to the collection container (not shown) therebelow.

Since the stripper fingers 4 and the ribs 5 are braced against one another in spite of their flexible construction these elements are precisely fixed in position. The configuration shown in the drawing results in the stripper fingers 4 retaining these positions during the comminution operation and even the forces thereon developed by the shredding of the paper do not lead to deformation of the stripper fingers 4 in a manner which is detrimental to their function. The injection-molding of the stripper block and the ribs 5 in the manner described allows the entire assembly to be fabricated at low cost.

The stripper fingers can be extended upwardly and the ribs 5 shortened or formed by bevel surfaces on the housing 11 directly if desired and, of course, it is possible to provide the stripping fingers 4 on the upper part 11 of the housing while the support ribs 5 are provided on the lower part of the housing. The support surfaces 9 and 10 in this case also function well.

The number of parts to the system is comparatively small and mounting is greatly simplified by comparison with earlier shredders. The stripper block 6 is simply dropped into its receptacle 8 whereupon the blade shafts 2, the motor 16 and the transmission 18 are mounted respectively in the bearing surfaces 14 and compartment 15 and the bearing surfaces 17. Then the upper housing part 11 is applied to position and fix the block 6 by the action of the interengagement of the surface 9 and 10 and the self-adjustment of the block 6 to the shafts 2.

We claim:

1. A blade and stripper assembly for a paper shredder,said assembly comprising:

a pair of longitudinally extending blade shafts;

transversely interdigitating rotating paper-shredder blades fixed on the shafts and forming interstices between the blades of each shaft;

a shredder housing receiving said blade shafts and formed with a receptacle extending longitudinally along and open toward said pair of blade shafts;

a stripper block formed as a separate piece from the receptacle and shredder housing, received with limited longitudinal play in said receptacle, and having rows of stripper fingers received in said interstices between the blades of the respective shafts; and respective support ribs formed in said housing and extending along said rows, said support ribs and said fingers having mutually transversely engaging complementary surfaces bracing said fingers against said ribs in an assembled state of said assembly.

2. The blade and stripper assembly defined in claim 1 wherein said receptacle is substantially tray shaped.

3. The blade and stripper assembly defined in claim 1 wherein said fingers and the respective ribs are angled with respect to one another at said surfaces.

4. The blade and stripper assembly defined in claim 1 wherein said block is a one-piece injection-molded element.

5. The blade and stripper assembly defined in claim 4 wherein said block is composed of a synthetic resin.

6. The blade and stripper assembly defined in claim 1 wherein said housing has an upper part and a lower part flanking said shafts and said block, said ribs being injection-molded in one piece with one of said parts.

7. The blade and stripper assembly defined in claim 6 wherein said one of said parts and said ribs are molded from a synthetic resin.

8. The blade and stripper assembly defined in claim 6 wherein said receptacle is formed in said lower part and said ribs are provided on said upper part.

9. The blade and stripper assembly defined in claim 8 wherein said receptacle is injection-molded in said lower part of said housing.

10. The blade and stripper assembly defined in claim 6 wherein said receptacle is injection-molded in one piece with the other of said parts.

11. The blade and stripper assembly defined in claim 1 wherein said housing has an upper part and a lower part flanking said shafts and said block, said receptacle being injection-molded in one piece with one of said parts.

* * * * *